US008468759B2

(12) United States Patent
Klein

(10) Patent No.: US 8,468,759 B2
(45) Date of Patent: Jun. 25, 2013

(54) FIRE RETARDANT COVER FOR FLUTED ROOF DECK

(75) Inventor: James A. Klein, Bellevue, WA (US)

(73) Assignee: BlazeFrame Industries Ltd., Redmond, WA (US)

( * ) Notice: Subject to any disclaimer, the term of this patent is extended or adjusted under 35 U.S.C. 154(b) by 192 days.

(21) Appl. No.: 13/018,144

(22) Filed: Jan. 31, 2011

(65) Prior Publication Data

US 2011/0185656 A1 Aug. 4, 2011

Related U.S. Application Data

(60) Provisional application No. 61/299,872, filed on Jan. 29, 2010.

(51) Int. Cl.
*E04H 9/16* (2006.01)
*E04H 9/00* (2006.01)

(52) U.S. Cl.
USPC ..... 52/241; 52/1; 52/317; 52/336; 52/481.1

(58) Field of Classification Search
USPC ..... 52/1, 317, 232, 241, 236.7, 481.1, 52/336, 262
See application file for complete search history.

(56) References Cited

U.S. PATENT DOCUMENTS

| | | | | |
|---|---|---|---|---|
| 4,351,870 | A * | 9/1982 | English, Jr. | 428/174 |
| 5,913,788 | A * | 6/1999 | Herren | 52/241 |
| 6,058,668 | A * | 5/2000 | Herren | 52/241 |
| 6,216,404 | B1 * | 4/2001 | Vellrath | 52/232 |
| 7,775,006 | B2 * | 8/2010 | Giannos | 52/241 |
| 8,087,205 | B2 * | 1/2012 | Pilz et al. | 52/232 |
| 8,181,404 | B2 * | 5/2012 | Klein | 52/232 |
| 2006/0137293 | A1 * | 6/2006 | Klein | 52/782.1 |
| 2009/0178363 | A1 * | 7/2009 | Pilz et al. | 52/710 |
| 2010/0126092 | A1 * | 5/2010 | Pilz et al. | 52/232 |
| 2011/0314757 | A1 * | 12/2011 | Pilz et al. | 52/232 |

OTHER PUBLICATIONS

System No. HW-D-0184, Assembly Rating, Class II Movement Capabilities, Hilti Firestop Systems, Reproduced by HILTI, Inc., Courtesy of Underwriters Laboratories, Inc., Apr. 23, 2007, pp. 1-3.
System No. HW-D-0457, Assembly Rating, Class II Movement Capabilities, Specified Technologies Inc., Reproduced courtesy of Underwriters Laboratories, Inc., May 7, 2009, pp. 1-2.

(Continued)

*Primary Examiner* — Phi A
(74) *Attorney, Agent, or Firm* — Thomas E. Loop

(57) ABSTRACT

A fire retardant cover is disclosed herein for covering a ceiling-side recess of a fluted roof deck and for providing a flat surface for installation of a head-of-wall track (associated with a steel stud wall assembly). The fluted roof deck has an undulating bottom surface that defines a plurality lengthwise recesses corresponding to a plurality of ceiling-side flutes of the fluted roof deck. The fire retardant cover is substantially flat and configured to sealingly cover at least one of the plurality of lengthwise recesses. The fire retardant cover comprises a piece of sheet metal bent to define first and second upwardly extending protrusions. The protrusions are spaced apart from each other by a substantially flat web section and have laterally facing outer top surfaces matched to sealingly contact lengthwise bottom surfaces of one of the plurality of recesses of the fluted roof deck when the fire retardant cover is installed.

3 Claims, 2 Drawing Sheets

OTHER PUBLICATIONS

System No. HW-D-0561, Assembly Rating, Class II Movement Capabilities, Reproduced courtesy of Underwriters Laboratories, Inc., May 2009, pp. 1-2.

System No. HW-D-01037, Assembly Rating, Class II Movement Capabilities, Hilti Firestop Systems, Reproduced by HILTI, Inc., Courtesy of Underwriters Laboratories, Inc., May 18, 2006, pp. 1-2.

XHBN.HW-D-0484, Joint Systems, Design/System/Construction/Assembly Usage Disclaimer, URL: http://12.32.81.40/cgi-bin/XYV/template/LISEXT/1FRAME/showpage.html?name=XHB.

SDI Manual of Construction with Steel Deck, Steel Deck Institute, 1992; pp. 1-47.

* cited by examiner

FIRE RETARDANT COVER FOR FLUTED ROOF DECK

CROSS-REFERENCE TO RELATED APPLICATIONS

This application claims the benefit of priority to U.S. Provisional Application No. 61/299,872 filed on Jan. 29, 2010, all of which application is incorporated herein by reference in its entirety for all purposes.

BACKGROUND OF THE INVENTION

In the building construction trade, a head-of-wall joint (also sometimes referred to as a top-of-wall joint) refers to the linear junction or interface existing between a top section of a framed wall assembly and the ceiling (where the ceiling is often times a concrete filled fluted steel roof deck (also sometime referred to as a corrugated roof pan deck)). In common practice, a typical wall to ceiling connection of a newly constructed buildings consists essentially of an inverted U-shaped elongated steel channel (or track) configured to receive steel studs between the legs (also sometimes referred to as sidewalls or flanges) of the shaped channel. A wallboard is generally attached to at least one side of the studs. The studs and wallboard are in many instances spaced apart from the ceiling a short gap distance in order to allow for ceiling deflections caused by seismic activity or moving overhead loads.

During the construction of a building, situations often arise where a wall assembly (or partition) is to be constructed directly beneath a recessed portion of a concrete filled fluted roof deck. In order to provide a flat and sufficiently rigid surface (backing support) necessary for subsequent installation of a head-of-wall track (wherein the head-of-wall track is part of a steel stud wall assembly), current methods of building construction call for the attachment of either a plurality of individual metal straps or a long continuously flat piece of sheet metal over the recessed portion (see, e.g., U.S. Pat. No. 5,913,788 to Herron for a good example of the use of a flat piece of sheet metal to cover a recessed portion of a concrete filled fluted roof deck). These prior art methods can generally provide a sufficiently rigid backing support member but for the construction of a fire rated partition the fluted space or recessed portion above the wall generally must also be filled or "stuffed" with a mineral wool type of insulation and then sometimes coated with fire resistive spray (to thereby prevent a fire from traveling over the partition and through the recessed fluted area and into the next room). FIG. 1 (prior art) shows such a configuration (namely, FIG. 1 shows a side cross-sectional view of a fire rated joint 2 between an upper end section of a sheet metal stud wall assembly 20 and a bottom surface 6 of a flat strap or continuous cover sheet 8 installed by fasteners 9 to cover and make flat an insulation 11 stuffed bottom recessed portion 24 of a concrete 26 filled fluted roof deck 14 in accordance with the prior art). The use of multiple straps or continuous flat sheets does not, however, sufficiently protect against the spread of a fire and/or smoke or seal against a hose stream (as is now required by modern municipal fire codes).

Accordingly, there is still a need in the art for new and improved building construction elements and related structural ceiling and wall assemblies that enable and facilitate the installation of head-of-walls track to fluted roof deck ceilings. The present invention fulfills these needs and provides for further related advantages.

SUMMARY OF THE INVENTION

In brief, the present invention is directed to a fire retardant cover for covering a ceiling-side recess of a fluted roof deck and for providing a flat surface for installation of a head-of-wall track (associated with a steel stud wall assembly). The fluted roof deck has an undulating bottom surface that defines a plurality lengthwise recesses corresponding to a plurality of ceiling-side flutes of the fluted roof deck. The fire retardant cover is substantially flat and configured to sealingly cover at least one of the plurality of lengthwise recesses. The fire retardant cover comprises a piece of sheet metal bent or otherwise shaped to define first and second upwardly extending protrusions. The protrusions are spaced apart from each other by a substantially flat web section, and each protrusion has a laterally facing outer top surface matched to sealingly contact a lengthwise bottom surface of one of the plurality of recesses of the fluted roof deck when the fire retardant cover is installed so as to cover a ceiling-side recess of the fluted roof deck.

The fire retardant cover further comprises first and second flange sections extending laterally away from the first and second upwardly extending protrusions, respectively, and with the first and second flange sections being coplanar with the web section. In some embodiments, the first and second upwardly extending protrusions each have a generally inverted V-shaped cross-sectional profile. In further embodiments, the fire retardant cover further comprises an intumescent material applied on the laterally facing outer top surfaces of the first and second lengthwise protrusions.

In another embodiment, the present invention is directed to a fluted roof deck having a fire retardant cover for covering a ceiling-side recess of the fluted roof deck and for providing a flat surface for installation of a head-of-wall track. The fluted roof deck has an undulating bottom surface that defines a plurality lengthwise recesses corresponding to a plurality of ceiling-side flutes of the fluted roof deck. The fire retardant cover is substantially flat and affixed to the bottom surface of the fluted roof deck so as to sealingly cover at least one of the plurality of lengthwise recesses. The fire retardant cover comprises a piece of sheet metal shaped to define first and second upwardly extending protrusions, wherein the protrusions are spaced apart from each other by a substantially flat web section, and wherein each protrusion has a laterally facing outer top surface that sealingly contacts a lengthwise bottom surface of one of the plurality of recesses of the fluted roof deck.

These and other aspects of the present invention may be more readily apparent upon reference to the accompanying drawings viewed in light of the detailed description of the invention.

BRIEF DESCRIPTION OF THE DRAWINGS

The drawings are intended to be illustrative of certain exemplary embodiments of the present invention and as such they are not necessarily drawn to scale. It is to be expressly understood that the various relative dimensions and geometries depicted in the drawings are exemplary of certain preferred embodiments. Finally, like reference numerals have been used to designate like elements and features throughout the several views of the drawings.

DETAILED DESCRIPTION OF THE INVENTION

Figure 3:
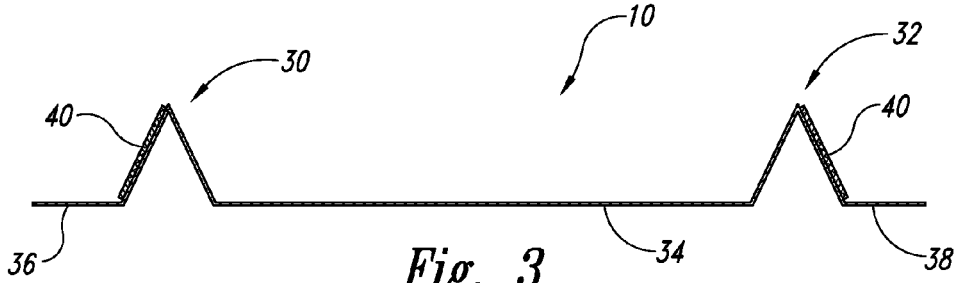
FIG. 3 is a side cross-sectional view of a fire retardant cover plate in accordance with another embodiment of the present invention, wherein the fire retardant cover plate is defined by a piece of sheet metal that has been bent (or otherwise shaped) to form first and second upwardly extending protrusions (with each protrusion having a generally inverted V-shaped cross-sectional profile as shown), and wherein an intumescent material has been applied onto the laterally facing outer top surfaces of the first and second lengthwise protrusions (i.e., an intumescent material strip has been applied along the outer surface of each inverted V-shaped protrusion).
Figure 4:
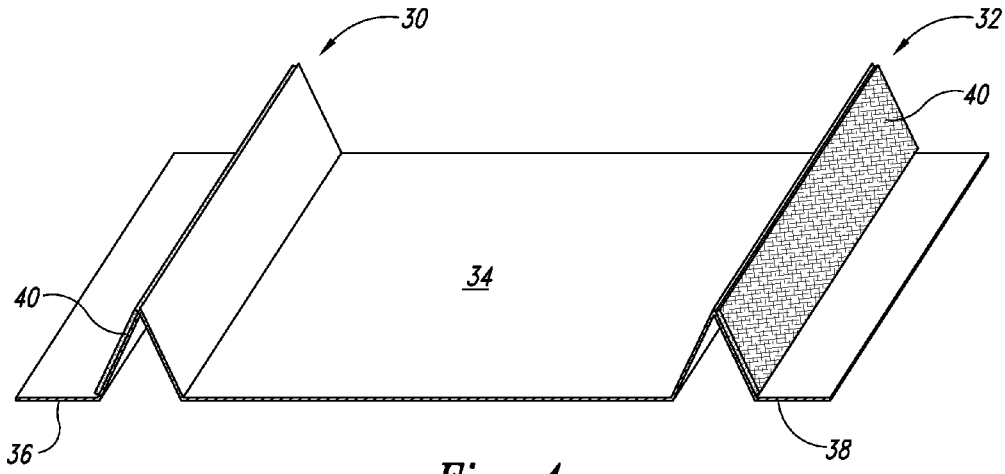
FIG. 4 is a side elevational perspective view of the fire retardant cover plate shown in FIG. 3.
Figure 5:
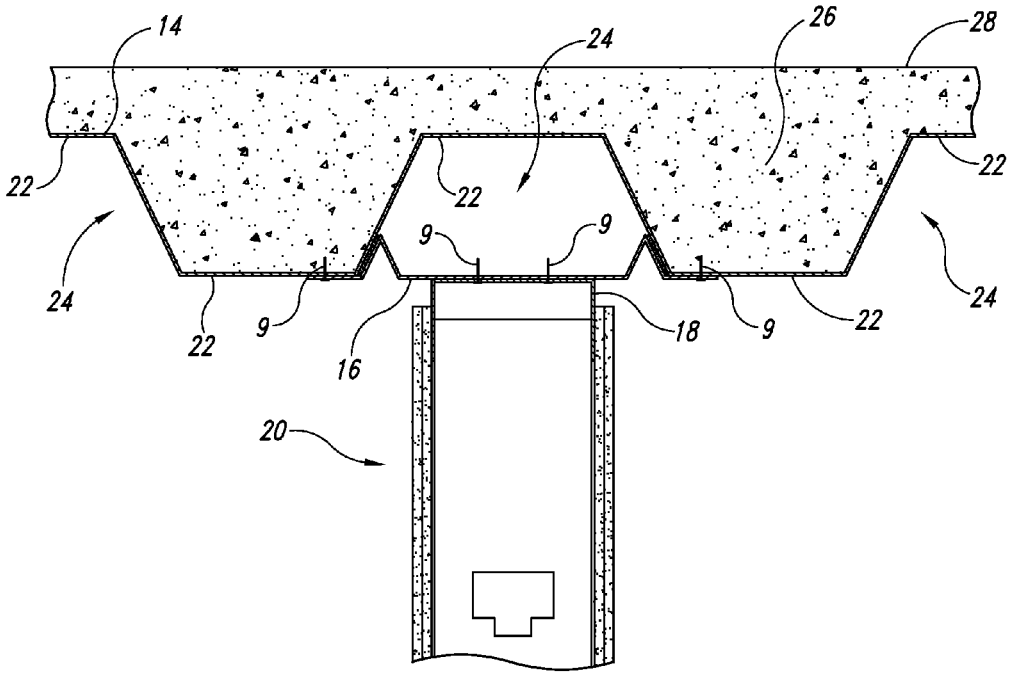
FIG. 5 is a side cross-sectional view of a fire rated joint between an upper end section of a sheet metal stud wall assembly and a bottom surface of a fire retardant cover plate in accordance with an embodiment of the present invention, wherein the fire retardant cover plate is defined by a piece of sheet metal that has been bent (or otherwise shaped) to form first and second upwardly extending protrusions (with each protrusion having a generally inverted V-shaped cross-sectional profile as shown), and wherein an intumescent material has been applied onto the laterally facing outer top surfaces of the first and second lengthwise protrusions (i.e., an intumescent material strip has been applied along the outer surface of each inverted V-shaped protrusion).

Referring now to the drawings and more particularly to FIGS. 2 to 5, the present invention is directed to a fire retardant cover 10 for covering a ceiling-side recess 24 of a fluted roof deck 14, and for providing a flat surface 16 (backing support) necessary for subsequent installation of a head-of-wall track 18 (wherein the head-of-wall track 18 is part of a steel stud wall assembly 20). As best shown in FIG. 5, the fluted roof deck 14 associated with the present invention has an undulating bottom surface 22 that defines a plurality lengthwise recesses 24 corresponding to a plurality of ceiling-side flutes 24 of the fluted roof deck 14. As also shown in FIG. 5, the fluted roof deck 14 has been filled with concrete 26 to thereby define a floor 28. The fire retardant cover 10 is substantially flat and configured to sealingly cover at least one of the plurality of lengthwise recesses 24 of the fluted roof deck 14.

Figure 1:
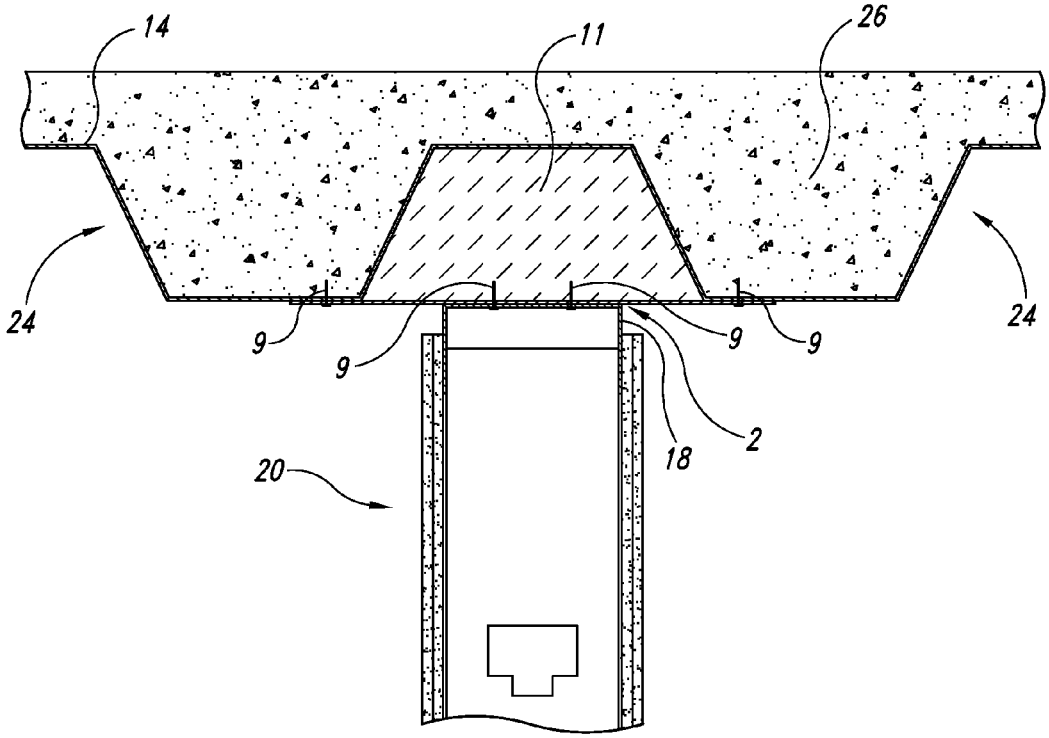
Fig. 1 (Prior Art)
FIG. 1 is a side cross-sectional view of a fire rated joint between an upper end section of a sheet metal stud wall assembly and a bottom surface of a flat strap or cover sheet installed by fasteners to cover and make flat a bottom recessed portion of a concrete filled fluted roof deck in accordance with the prior art.
Figure 2:
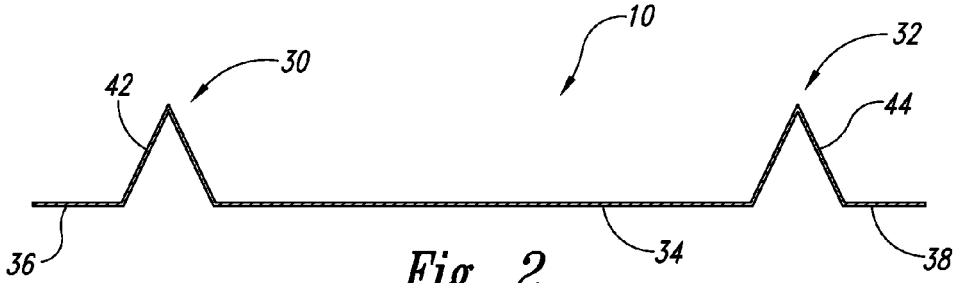
FIG. 2 is a side cross-sectional view of a fire retardant cover plate in accordance with an embodiment of the present invention, wherein the fire retardant cover plate is defined by a piece of sheet metal that has been bent (or otherwise shaped) to form first and second upwardly extending protrusions (with each protrusion having a generally inverted V-shaped cross-sectional profile as shown).

As best shown in FIGS. 2-4, the fire retardant cover 10 of the present invention comprises a piece of sheet metal (rectangular shaped in some embodiments) bent to define first and second upwardly extending protrusions 30, 32. The first and second protrusions 30, 32 are spaced apart from each other by a substantially flat web section 34, and are bounded by first and second laterally extending flange sections 36, 38 that are coplanar with the web section 34. The first and second protrusions 30, 32 each have a generally inverted V-shaped cross-sectional profile.

As best shown in FIG. 4, the fire retardant cover 10 in a further embodiment of the present invention comprises an intumescent material 40 that has been applied on the laterally facing outer top surfaces 42, 44 (shown in FIG. 2) of the first and second lengthwise protrusions 30, 32. In this configuration, each protrusion 30, 32 has a laterally facing outer top surface 42, 44 matched to sealingly contact a lengthwise bottom surface 22 of one of the plurality of recesses 24 of the fluted roof deck 14 (when the fire retardant cover 10 is installed so as to cover a ceiling-side recess 24 of the fluted roof deck 14).

The intumescent material 40 associated with certain preferred embodiments of the present invention is commercially available (e.g., 3M Company or The Rectorseal Corporation, U.S.A.) and preferably has an adhesive backing that allows it to be readily affixed onto the laterally facing outer top surfaces 42, 44 of the first and second lengthwise protrusions 30, 32. Exemplary in this regard are the heat expandable compositions disclosed in U.S. Pat. No. 6,207,085 to Ackerman (incorporated herein by reference), which discloses a composition that, when subjected to heat, expands to form a heat-insulating barrier. A preferred composition contains expandable graphite (~10-40 wt %), a fire retardant (~10-40 wt %), and an optional inorganic intumescent filler (<50 wt %), all of which are admixed together with a resinous emulsion (~30-60 wt %). The expandable graphite is generally manufactured by the oxidation of graphite flake in sulfuric acid (with such intercalated graphite being swellable or expandable up to about 100 times of its original volume when heated at high temperature). The fire retardant generally includes amine/phosphorous containing salts such as, for example, amine salts of phosphoric acid or lower alkyl esters thereof. A preferred fire retardant is a $C_2$-$C_8$ alkyl diamine phosphate. Intumescent activation or expansion generally begins at about 392° F.

In order to ensure that the intumescent material 40 stays in place when exposed to heat, it has been found that a commercially available (e.g., 3M Company, U.S.A.) fire-retardant epoxy adhesive (not shown) may preferably also be used. In other words, a fire-retardant adhesive (not shown) may be interposed between the intumescent material 40 and the laterally facing outer top surfaces 42, 44 of the first and second lengthwise protrusions 30, 32. In some embodiments, the intumescent material 40 may on its top surface include a protective foil tape or polymeric coating (not shown) to protect the underlying intumescent material 40.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions, and all changes that come within the meaning and range of equivalency of the claims are to be embraced within their scope.

What is claimed is:

1. A fluted roof deck having a fire retardant cover for covering a ceiling-side recess of the fluted roof deck and for providing a flat surface for installation of a head-of-wall track, wherein the fluted roof deck has an undulating bottom surface that defines a plurality lengthwise recesses corresponding to a plurality of ceiling-side flutes of the fluted roof deck and with the fire retardant cover being substantially flat and affixed to the bottom surface of the fluted roof deck so as to sealingly cover at least one of the plurality of lengthwise recesses, and wherein the fire retardant cover comprises a piece of sheet metal having a length, width and thickness, the piece of sheet metal being shaped to define elongated first and second upwardly extending protrusions, wherein the lengthwise protrusions are spaced apart from each other by a substantially flat elongated web section, and wherein the lengthwise protrusions and the substantially flat web section are parallel to one another along their respective lengths, and wherein each lengthwise protrusion has a laterally facing outer top surface that sealingly contacts a lengthwise bottom surface of one of the plurality of recesses of the fluted roof deck;

an intumescent material applied on the laterally facing outer top surfaces of the first and second lengthwise protrusions.

2. The fluted roof deck having a fire retardant cover of claim 1, further comprising first and second flange sections extending laterally away from the first and second upwardly extending protrusions, respectively, and with the first and second flange sections being coplanar with the web section.

3. The fluted roof deck having a fire retardant cover of claim 1 wherein the first and second upwardly extending protrusions each have a generally inverted V-shaped cross-sectional profile.

* * * * *